US009585433B1

(12) United States Patent
Heimer et al.

(10) Patent No.: US 9,585,433 B1
(45) Date of Patent: Mar. 7, 2017

(54) FIBER REINFORCED HELMET

(71) Applicant: RAWLINGS SPORTING GOODS COMPANY, INC., St. Louis, MO (US)

(72) Inventors: Douglas Wade Heimer, Caledonia, MN (US); Matthew V. Vacek, La Crosse, WI (US); Biju Mathew, St. Charles, MO (US); Scott Jeffrey Sorensen, St. Louis, MO (US)

(73) Assignee: Rawlings Sporting Goods Company, Inc., St. Louis, MO (US)

( * ) Notice: Subject to any disclaimer, the term of this patent is extended or adjusted under 35 U.S.C. 154(b) by 948 days.

(21) Appl. No.: 13/795,009

(22) Filed: Mar. 12, 2013

Related U.S. Application Data

(60) Provisional application No. 61/641,328, filed on May 2, 2012.

(51) Int. Cl.
*A42B 3/06* (2006.01)

(52) U.S. Cl.
CPC ..... *A42B 3/063* (2013.01)

(58) Field of Classification Search
CPC ..... A42B 3/062; A42B 3/063; A42B 3/064; F41H 1/04
See application file for complete search history.

(56) References Cited

U.S. PATENT DOCUMENTS 4,242,406 A 12/1980 El Bouhnini et al.
4,665,569 A 5/1987 Santini
4,953,234 A 9/1990 Li et al.
5,075,904 A 12/1991 Shirasaki et al.
5,537,687 A 7/1996 Garza
5,544,367 A 8/1996 March, II
5,794,271 A 8/1998 Hastings
5,950,244 A 9/1999 Fournier et al.
5,952,078 A 9/1999 Park
6,219,850 B1 4/2001 Halstead et al.
6,434,755 B1 8/2002 Halstead et al.
6,468,644 B1 10/2002 Hong et al.
6,604,246 B1 8/2003 Obreja
6,676,884 B2 1/2004 Hong et al.
6,911,247 B2 6/2005 Howland
6,925,657 B2 8/2005 Takahashi et al.
7,089,602 B2 8/2006 Talluri
7,096,512 B2 8/2006 Blair
(Continued)

OTHER PUBLICATIONS

NOCSAE, Standard Performance Specification for Newly Manufactured Baseball/Softball Batter's Helmets, Aug. 2011, 9 pages, NOCSAE DOC (ND) 022-10m11a.

(Continued)

*Primary Examiner* — Shaun R Hurley
*Assistant Examiner* — Andrew W Sutton
(74) *Attorney, Agent, or Firm* — Husch Blackwell LLP

(57) ABSTRACT

A helmet with an outer shell made from a fiber reinforced material, and preferably a fiber reinforced polymer. The helmet preferably has a critical impact area that contains a greater concentration of fibers. Preferably, the helmet has a weight, offset, and dimensions which are comparable to a helmet with an outer shell that is not made from a fiber reinforced material. The helmet is preferably stiffer and more protective than a conventional helmet not having a fiber reinforced outer shell.

21 Claims, 8 Drawing Sheets

(56) References Cited

U.S. PATENT DOCUMENTS

| | | | | |
|---|---|---|---|---|
| 7,849,524 | B1 | 12/2010 | Williamson et al. | |
| 7,913,325 | B2 | 3/2011 | Bullock | |
| 7,979,918 | B2 | 7/2011 | Sandusky et al. | |
| 8,132,494 | B1 | 3/2012 | Nguyen et al. | |
| 8,230,527 | B2 | 7/2012 | Jeong et al. | |
| 9,107,466 | B2 * | 8/2015 | Hoying | A42B 3/069 |
| 2004/0168246 | A1 | 9/2004 | Phillips | |
| 2006/0112477 | A1 * | 6/2006 | Schneider | A42B 3/063 2/412 |
| 2006/0248623 | A1 | 11/2006 | Miller | |
| 2009/0064385 | A1 | 3/2009 | Crossman et al. | |
| 2010/0229271 | A1 * | 9/2010 | Marissen | F41H 1/08 2/2.5 |
| 2010/0275337 | A1 | 11/2010 | Bhatnagar et al. | |
| 2011/0047680 | A1 | 3/2011 | Hoying et al. | |

OTHER PUBLICATIONS

NOCSAE, Standard Performance Specification for Newly Manufactured Baseball/Softball Batter's Helmets, May 2012, 9 pages, NOCSAE DOC (ND) 022-10m12.

NOCSAE, Standard Test Method and Equipment Used in Evaluating the Performance Characteristics of Protective Headgear/Equipment, Jan. 2011, 29 pages, NOCSAE DOC (ND) 001-11m11.

NOCSAE, Standard Projectile Impact Test Method and Equipment Used in Evaluating the Performance Characteristics of Protective Headgear, Faceguards or Projectiles, Jul. 2009, 13 pages, NOCSAE DOC (ND) 021-98m09.

NOCSAE, Standard Projectile Impact Test Method and Equipment Used in Evaluating the Performance Characteristics of Protective Headgear, Faceguards or Projectiles, Aug. 2011, 13 pages, NOCSAE DOC (ND) 021-11m12.

NOCSAE, Laboratory Procedural Guide for Certifying Newly Manufactured Baseball/Softball Batter's Helmets, Feb. 2011, 6 pages, NOCSAE DOC (ND) 023-98m11.

Toray Carbon Fibers America, Inc., Torayca® Technical Data Sheet, accessed Mar. 2012 from http://www.toraycfa.com, 2 pages, No. CFA-005, Santa Ana, California.

System Three Resins, Phase Two® Composite Resin System Technical Data Sheet, accessed Mar. 2012 from www.systemthree.com, 1 page.

System Three Resins, QuikFair™ Epoxy Fairing Putty Technical Data Sheet, accessed Mar. 2012 from www.systemthree.com, 1 page, System Three Resins, Inc., Auburn, Washington.

Airtech Advanced Materials Group, ECONO WEAVE Data Sheet, Aug. 24, 2007, 2 pages.

Hendricks, W. Kern, Using Phase Two™ Epoxy Resin, 1992, 5 pages, System Three Resins, Seattle, Washington.

Hendricks, W. Kern, Two-Phase Epoxy Systems for Composite Cored Boat Construction, 1986, 6 pages, System Three Resins, Seattle, Washington.

System Three Resins, The Epoxy Book, 2006, 40 pages, System Three Resins, Seattle, Washington.

Der-Tex Corporation, Cell-Flex Impax Vinyl Nitrile Specifications, published prior to May 2, 2012, 1 page, Der-Tex Corporation, Saco, Maine.

* cited by examiner

Fig.5.
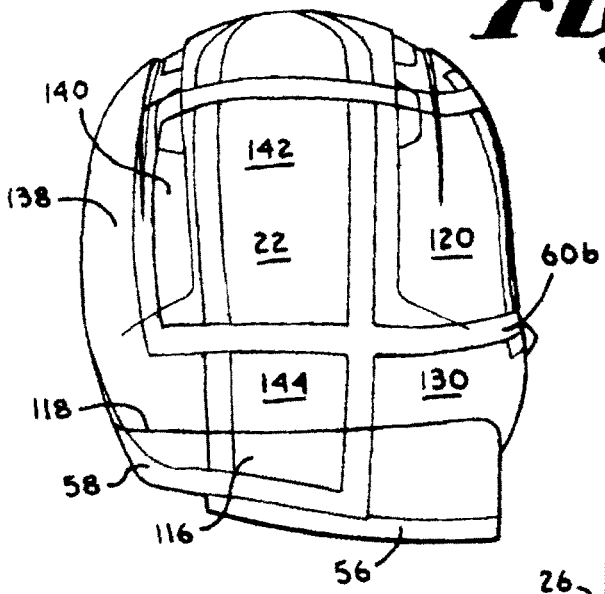
Fig.6.
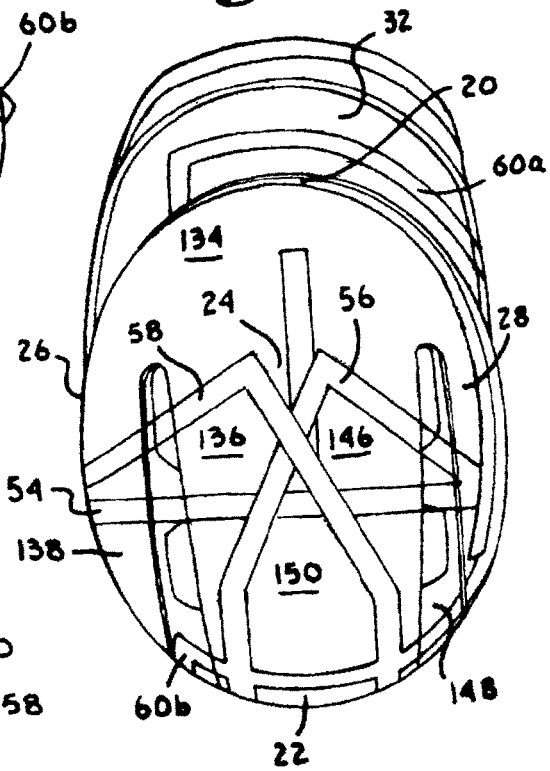
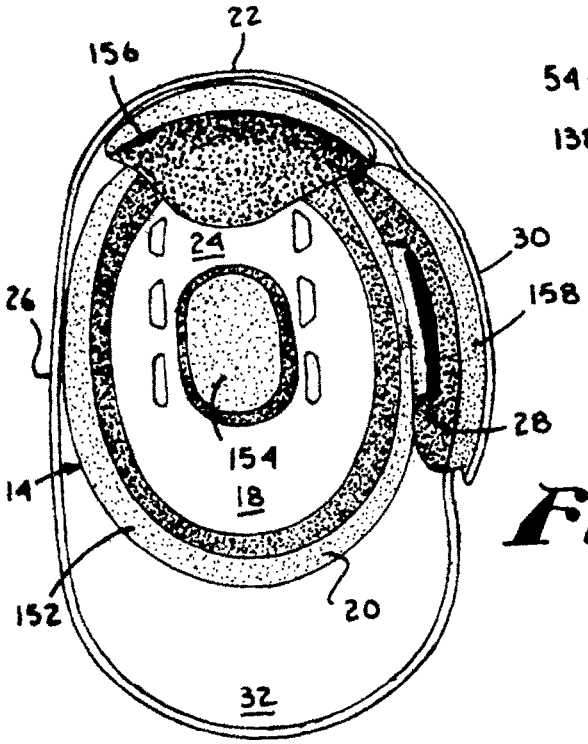
Fig.7.

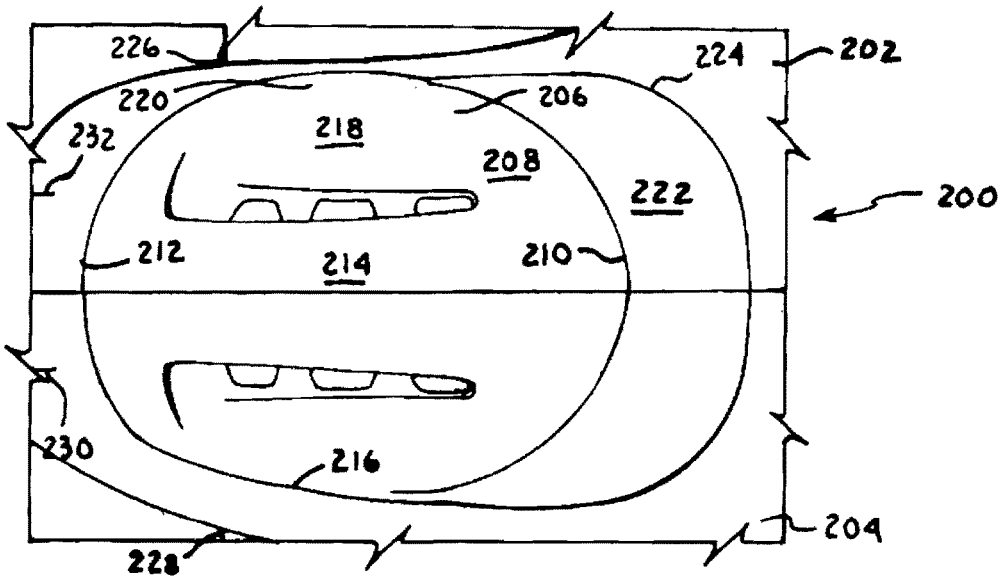
Fig. 12.
Fig. 13.
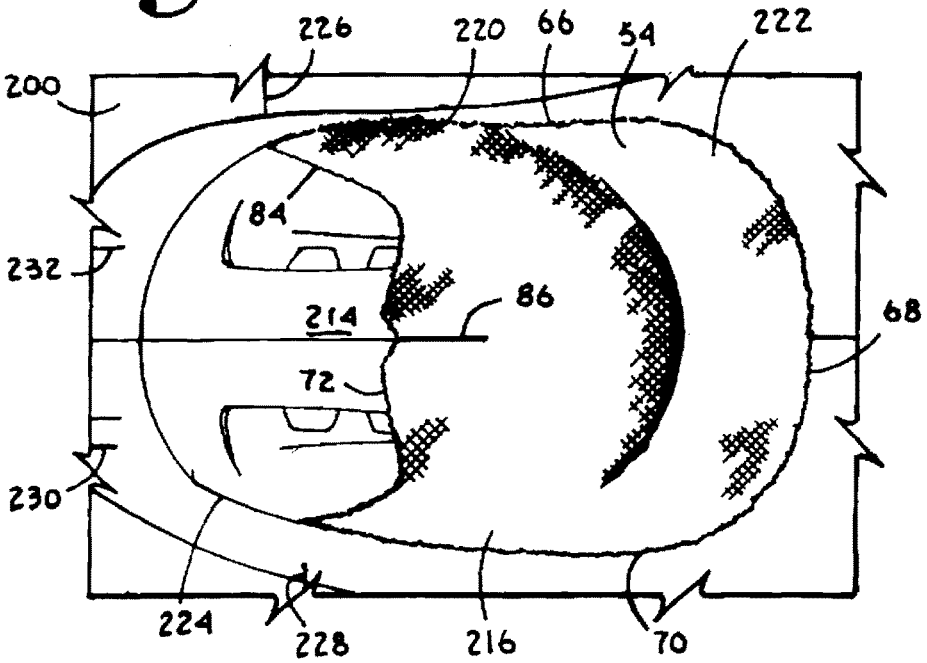

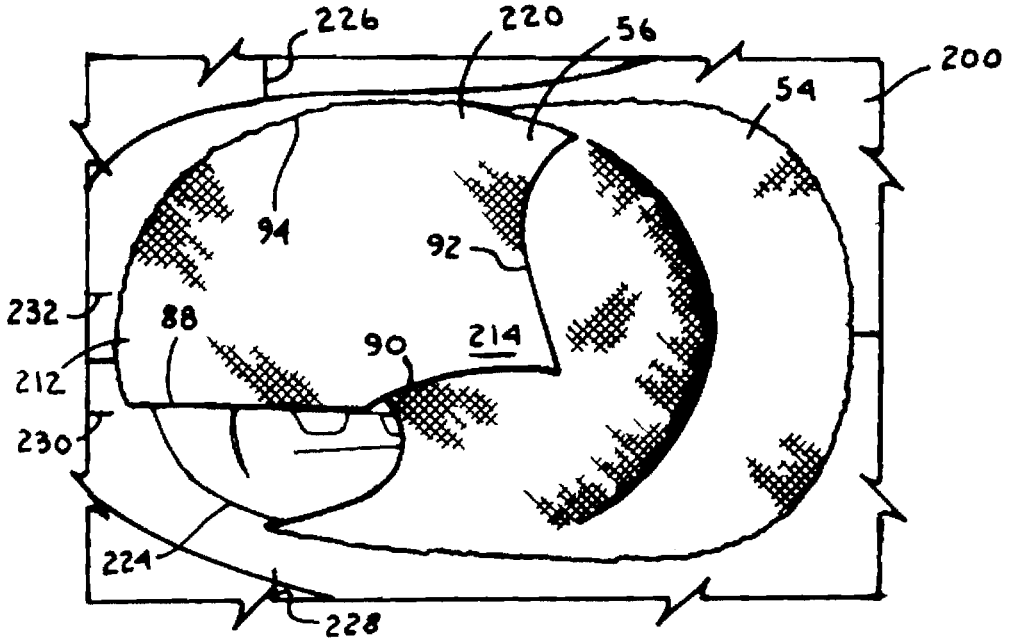
Fig. 14.
Fig. 15.
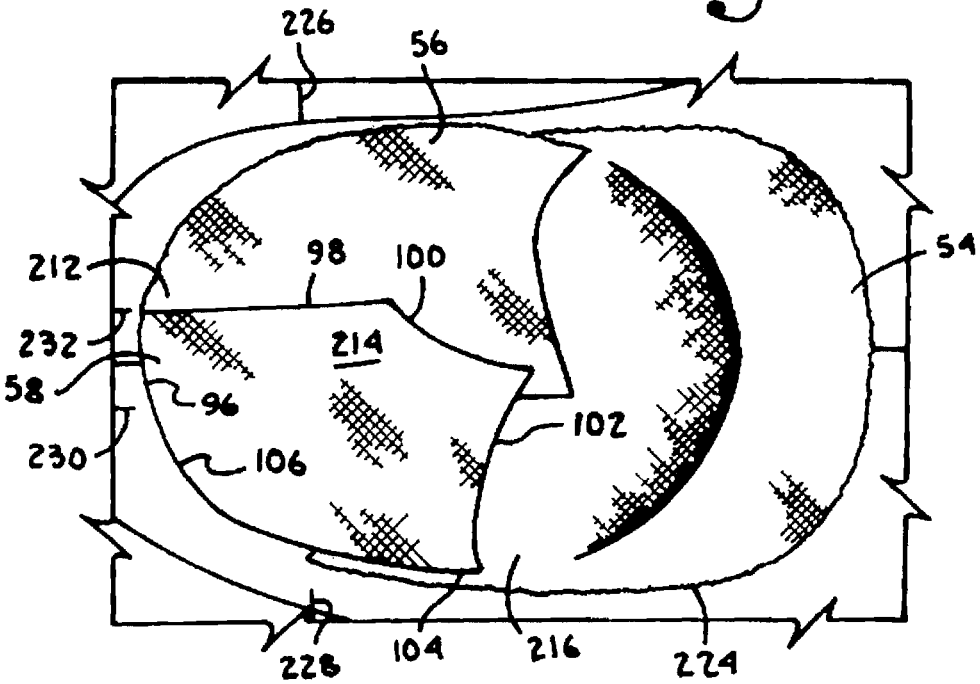

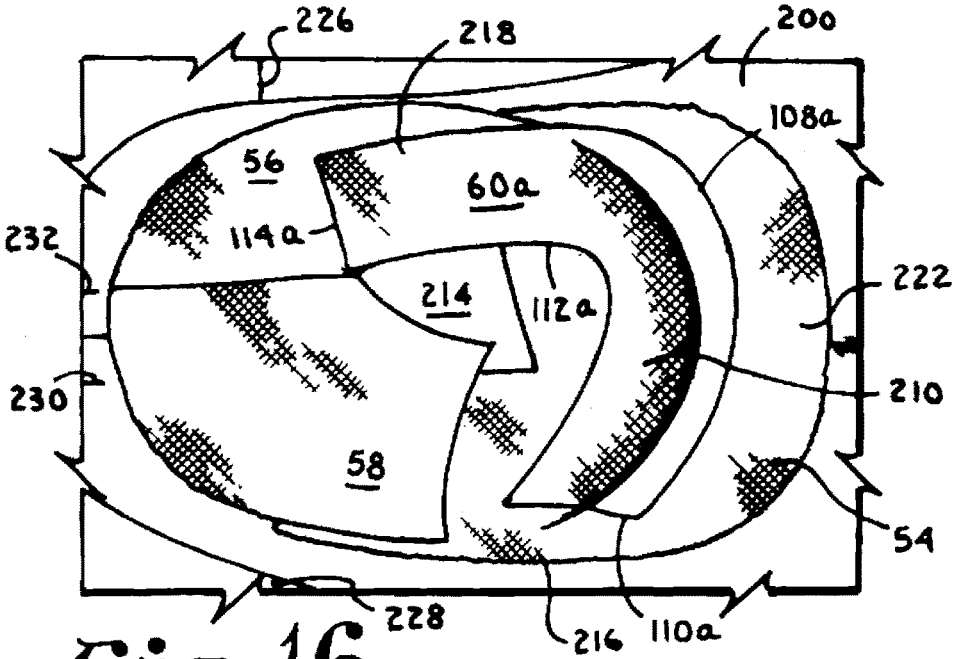
Fig.16.
Fig.17.
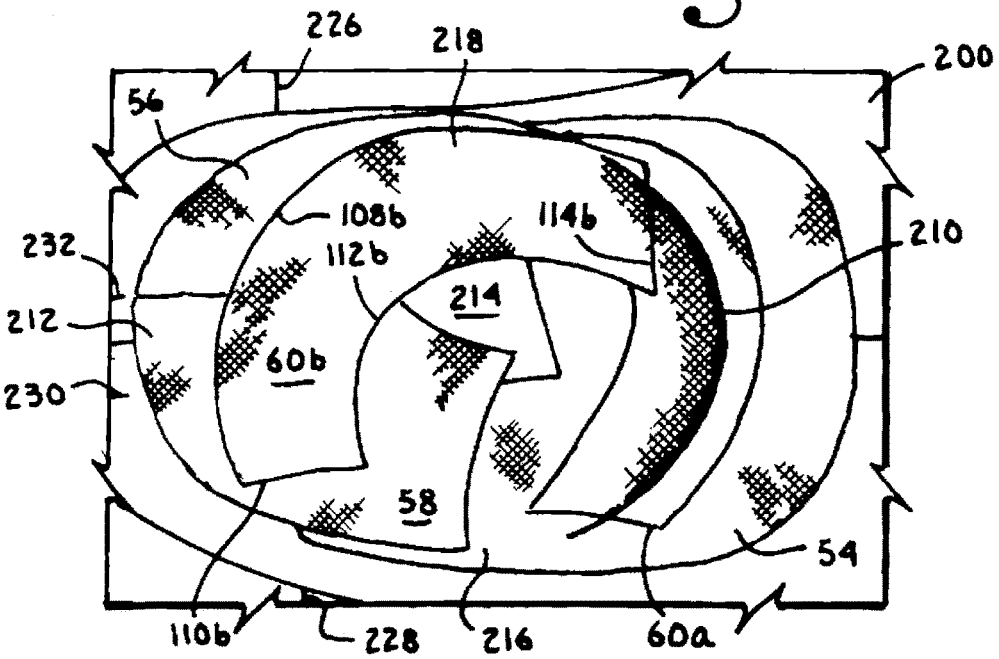

FIBER REINFORCED HELMET

CROSS-REFERENCE TO RELATED APPLICATIONS

This application is based on and claims priority to U.S. Provisional Application Ser. No. 61/641,328, filed on May 2, 2012, which is incorporated herein by reference in its entirety.

STATEMENT REGARDING FEDERALLY SPONSORED RESEARCH OR DEVELOPMENT

Not applicable.

BACKGROUND OF THE INVENTION

1. Field of the Invention

The present invention is directed toward a helmet, and in particular, to a helmet having an outer shell made from a fiber reinforced material.

2. Description of Related Art

There are many types of conventional helmets used for a wide variety of activities including sporting events and motorcycle riding. Most conventional sporting helmets include an outer shell made from a polymeric material and padding affixed to an inner surface of the outer shell to absorb energy from an impact to the shell. Conventional baseball batting helmets have an outer shell that is made from a polymeric material that is relatively flexible such as acrylonitrile butadiene styrene. In order to enhance the stiffness and protection adjacent the ear flaps or side of the head, it is known to provide a baseball batting helmet with an insert made from a relatively stiff fiber reinforced polymer affixed to an inner surface of the outer shell adjacent the ear flaps. While the insert enhances stiffness and protection adjacent the ear flaps, the insert also increases the weight, offset, and dimensions of the helmet so that it does not closely resemble a conventional helmet.

BRIEF SUMMARY OF THE INVENTION

The present invention is directed to a helmet having an outer shell made from a fiber reinforced material, preferably a fiber reinforced polymeric material. The outer shell may be made from any type of fiber and any type of polymer. For example, the fiber may be carbon, glass, or aramid fibers, and the polymer may be a thermoset, such as epoxy, or a thermoplastic, such as polycarbonate or acrylonitrile butadiene styrene. Preferably, the outer shell of the helmet has a critical impact area that contains a greater concentration of fibers than the remainder of the outer shell. The greater concentration of fibers in the critical impact area preferably increases the stiffness of the helmet in the critical impact area and increases the level of protection that the helmet provides to a wearer. In one embodiment, there are overlapping fiber layers in the critical impact area containing fibers that are oriented in different directions. The outer shell is preferably constructed entirely from a fiber reinforced polymer.

In one embodiment, the helmet is a baseball batting helmet that has a weight, size, and offset, which is the distance between a wearer's head and an inner surface of the outer shell, which are comparable or substantially similar to the weight, size, and offset of conventional baseball batting helmets with an outer shell that is not made from a fiber reinforced polymer. Preferably, the fiber reinforced polymeric outer shell makes the helmet stiffer and more protective than a conventional baseball batting helmet.

Preferably, the helmet has a weight of between approximately 17 to 21 ounces, and most preferably between approximately 18 to 20 ounces. The offset of the helmet, or the thickness of padding affixed to an inner surface of the outer shell, is preferably between approximately 0.25 to 1.25 inches. In other embodiments, the helmet preferably has an offset or padding thickness of between approximately 0.25 to 0.75 inches, between approximately 0.25 to 0.5 inches, or approximately 0.28 inches.

The helmet preferably has a Severity Index, as defined in the National Operating Committee on Standards for Athletic Equipment's (NOCSAE) Standard Test Method and Equipment Used in Evaluating the Performance Characteristics of Protective Headgear/Equipment (NOCSAE DOC 001-11m11), of not greater than 750, and most preferably not greater than 500, when tested in accordance with NOCSAE's Standard Performance Specification for Newly Manufactured Baseball/Softball Batter's Helmets (NOCSAE DOC 022-10m11a), as modified so that all projectiles used in the test are baseballs, the velocity of all baseballs used in the test is approximately 90 miles per hour, and all tests are conducted at ambient temperature.

The helmet is also preferably relatively stiff such that it resists flexing when a force is applied to left and right sides of the outer shell. When the helmet is positioned between two flat plates such that each plate abuts one of the left and right sides and the plates compress the left and right sides toward each other, the plates must exert a pressure of preferably greater than 60 pounds per square inch to decrease the distance between the left and right sides by one inch. In another embodiment of helmet, the plates must exert a pressure of between approximately 80 to 120 pounds per square inch to decrease the distance between the left and right sides by one inch.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

FIG. 5 is a rear elevational view of the helmet of FIG. 1A;

FIG. 6 is a top plan view of the helmet of FIG. 1A;

FIG. 7 is a bottom plan view of the helmet of FIG. 1A;

FIG. 12 is a top plan view of a mold used to make the helmet of FIG. 1A;

FIG. 13 is a top plan view of the mold with the first woven fiber layer placed in the mold;

FIG. 14 is a top plan view of the mold with the second woven fiber layer placed in the mold;

FIG. 15 is a top plan view of the mold with the third woven fiber layer placed in the mold;

FIG. 16 is a top plan view of the mold with the fourth woven fiber layer placed in the mold;

FIG. 17 is a top plan view of the mold with another of the fourth woven fiber layers placed in the mold.

DETAILED DESCRIPTION OF PREFERRED EMBODIMENT

Figure 1A:
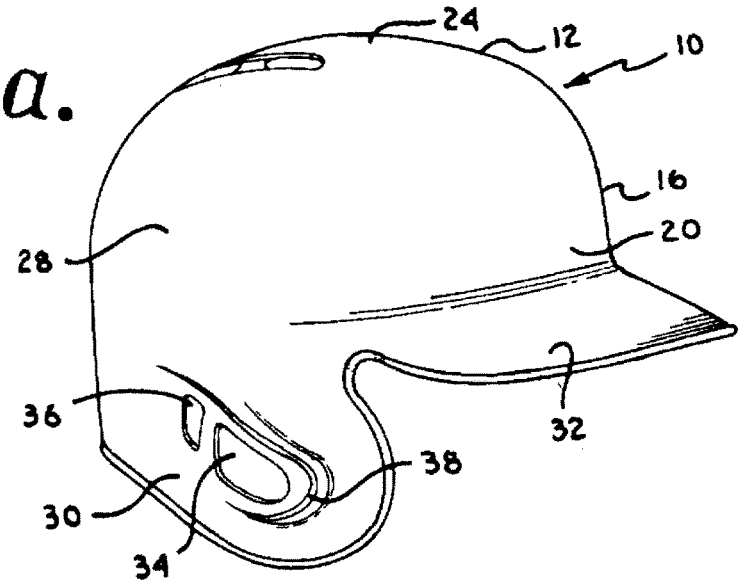
FIG. 1A is a front perspective view of one embodiment of batting helmet in accordance with the present invention.

A helmet in accordance with the present invention is shown generally in FIG. 1A as 10. The helmet 10 is a baseball batting helmet; however, other types of helmets are within the scope of the present invention. The helmet 10 includes a fiber reinforced outer shell 12 and padding 14 (FIG. 7) positioned inside of the outer shell 12. The outer shell 12 includes an outer surface 16 and an inner surface 18 (FIG. 7) to which the padding 14 is affixed. The helmet 10 preferably has a weight and an offset, which is the distance between a wearer's head and inner surface 18, that are comparable to those of a conventional batting helmet. Helmet 10 also has a stiffness that is greater than that of a conventional batting helmet, and is more protective than a conventional batting helmet due to the outer shell 12 consisting of a fiber reinforced material. Preferably, outer shell 12 is made solely from a fiber reinforced polymer.

Figure 1B:
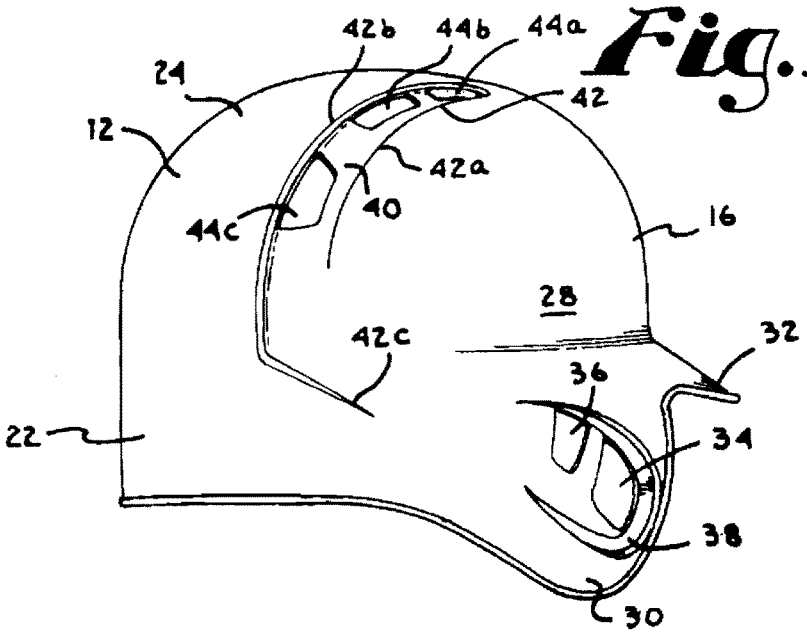
FIG. 1B is a rear perspective view of the helmet of FIG. 1A.
Figure 2:
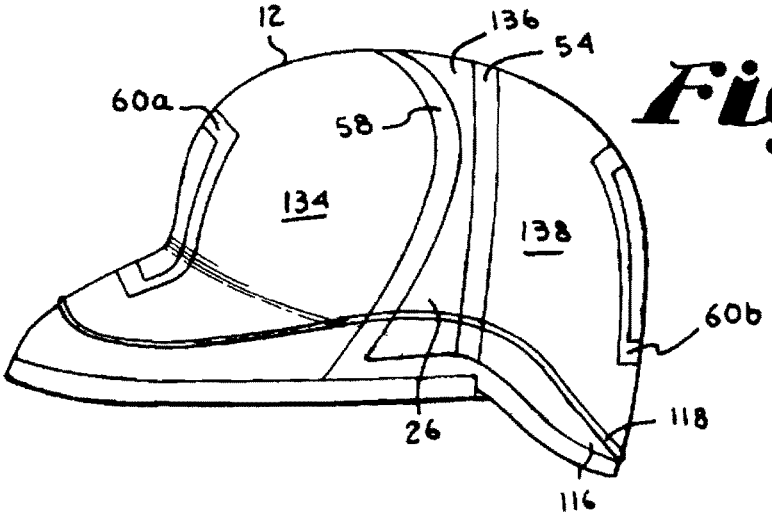
FIG. 2 is a left elevational view of the helmet of FIG. 1A.

Referring to FIGS. 1A, 1B, and 2 the outer shell 12 includes a front 20, rear 22, crown 24, left side 26 (FIG. 2), right side 28, an ear flap 30 that is integrally joined with and extends downward from the right side 28, and a bill 32 that is integrally joined with and extends outward from the front 20. The ear flap 30 includes two ear holes 34 and 36 and a generally U-shaped ridge 38 that surrounds a portion of the holes 34 and 36. It is within the scope of the invention for the helmet to have an ear flap, like ear flap 30, that is integrally joined with and extends downward from the left side 26 of the helmet in addition to, or as an alternative to, ear flap 30. Further, it is within the scope of the invention for the helmet 10 to not have ear flap 30.

Referring to FIG. 1B, the outer surface 16 includes a depression 40 that extends from the crown 24 to the rear 22. A U-shaped ridge 42 having two generally parallel sides 42*a* and 42*b* surrounds the depression 40. Side 42*b* extends farther downward into the rear 22 than side 42*a*. A ridge 42*c* is integral with side 42*b* and extends outward toward the right side 28 of the outer shell 12. Three vent holes 44*a*, 44*b*, and 44*c* are positioned within the depression 40. The outer surface 16 also includes a depression, U-shaped ridge, ridge, and vent holes that are mirror images of depression 40, U-shaped ridge 42, ridge 42*c*, and vent holes 44*a*, 44*b*, and 44*c*, respectively, on an opposite side of a vertical plane passing through the center of crown 24, front 20, and rear 22.

As described in detail below, fiber layers 54, 56, 58, and 60, shown in FIGS. 8-11, respectively, are used to make outer shell 12. Except for their shape, each of the fiber layers 54, 56, 58, and 60 is substantially similar. Thus, the construction of each is described herein with reference to layer 54 shown in FIG. 8. Layer 54 is woven from a plurality of weft and warp tows, 62 and 64, respectively, that are oriented generally perpendicular to each other. Each of the weft and warp tows 62 and 64 includes a plurality of fibers, preferably approximately 12,000 fibers per tow, that are generally oriented in a direction extending the length of the tows 62 and 64. The weft and warp tows 62 and 64 are preferably woven in a four harness satin weave, which means that the weft tow 62 passes over three consecutive warp tows 64 before passing under a warp tow 64. The four harness satin weave is preferable because it is relatively pliable, which ensures that the layers 54, 56, 58, and 60 are able to closely conform to the curvature of a mold that receives the layers 54, 56, 58, and 60 to make the helmet 10. Each of the layers 54, 56, 58, and 60 is preferably cut from a roll of standard modulus 12K woven carbon fiber sold by Toray Carbon Fibers America, Inc. under the name T700S. Each of layers 54, 56, 58, and 60 preferably has a weight per area of approximately 660 grams per square meter, and a tensile strength of 745 kilopounds per square inch.

Although fiber layers 54, 56, 58, and 60 are preferably made from carbon fibers, it is within the scope of the invention for the layers to be made from any type of fibers, such as glass fibers and aramid fibers, including those sold under the trade name Kevlar. Further, it is within the scope of the invention for the layers to be knit from tows of fiber, for the layers to comprise a non-woven mat of randomly oriented fibers, or for the layers to comprise a mat of unidirectional fibers. Additionally, it is within the scope of the invention for different layers 54, 56, 58, and 60 to include different types of fibers. For example, layers 54 and 58 may be carbon fiber layers, while layers 56 and 60 are aramid or glass layers. Preferably, if the helmet 10 has two ear flaps, such as ear flap 30 shown in FIG. 1A, the helmet 10 is made from fiber layers that are relatively flexible, such as glass fibers, so that a user can pull apart the ear flaps to don the helmet.

Figure 8:
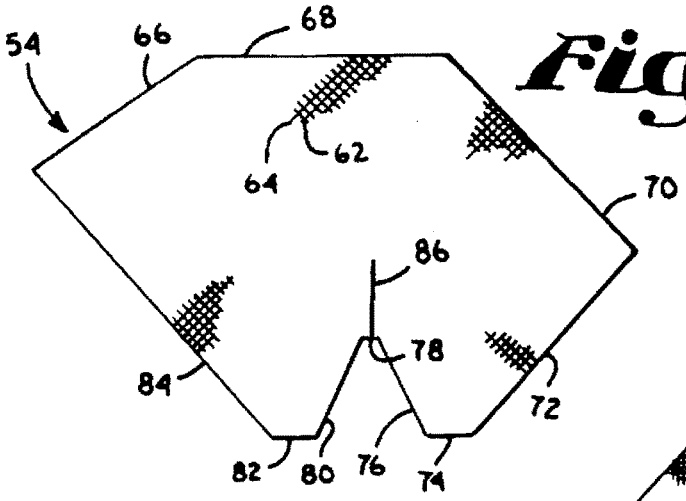
FIGS. 8-11 are top plan views of first, second, third, and fourth woven fiber layers of the helmet of FIG. 1A.

Referring now to FIG. 8, layer 54 is a substantially 2-dimensional sheet of fiber having linear sides 66, 68, 70, 72, 74, 76, 78, 80, 82, and 84. The layer 54 is cut generally perpendicular to side 78 to create a slit 86 having a length of approximately 3 inches. The interior angles between the sides 66, 68, 70, 72, 74, 76, 78, 80, 82, and 84 are approximately as follows: 145 degrees between sides 66 and 68, 135 degrees between sides 68 and 70, 95 degrees between sides 70 and 72, 130 degrees between sides 72 and 74, 115 degrees between sides 74 and 76, 245 degrees between sides 76 and 78, 245 degrees between sides 78 and 80, 115 degrees between sides 80 and 82, 130 degrees between sides 82 and 84, and 85 degrees between sides 84 and 66.

Figure 9:
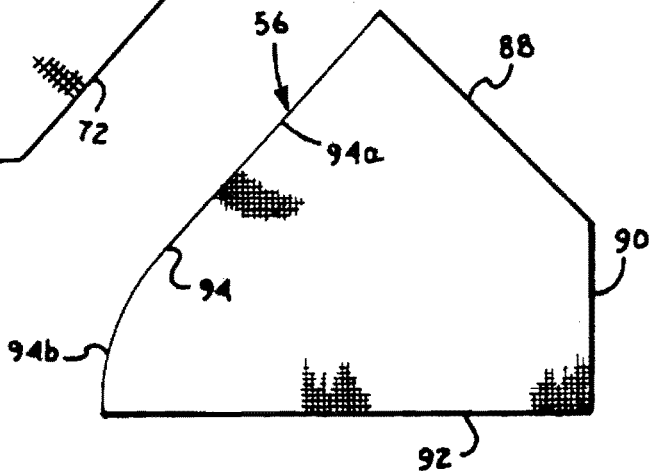

Layer 56, shown in FIG. 9, is a substantially 2-dimensional sheet of fiber having sides 88, 90, 92, and 94. Side 94 has a substantially linear portion 94*a* extending downward from side 88, and an arcuate portion 94*b* between linear portion 94*a* and side 92. Sides 88, 90, and 92 are linear. The interior angles between the sides 88, 90, 92, and 94 are approximately as follows: 135 degrees between sides 88 and 90, 90 degrees between sides 90 and 92, 90 degrees between sides 92 and 94, and 85 degrees between sides 94 and 88. While the arcuate portion 94*b* of side 94 forms an angle of approximately 90 degrees with side 92, if the linear portion 94*a* of side 94 and side 92 were extended to meet, the angle between the sides 92 and 94 would be approximately 50 degrees.

Figure 10:
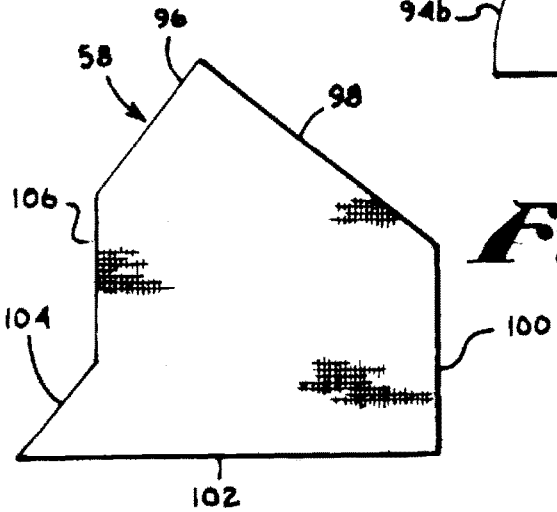

Referring to FIG. 10, layer 58 is a substantially 2-dimensional sheet of fiber having linear sides 96, 98, 100, 102, 104, and 106. The interior angles between the sides 96, 98, 100, 102, 104, and 106 are approximately as follows: 90 degrees between sides 96 and 98, 130 degrees between sides 98 and 100, 90 degrees between sides 100 and 102, 50 degrees between sides 102 and 104, 220 degrees between sides 104 and 106, and 140 degrees between sides 106 and 96.

Figure 11:
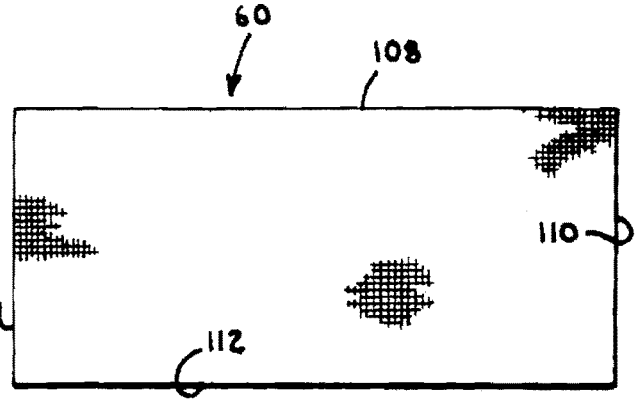

Layer 60, shown in FIG. 11, is rectangular shaped with four linear sides 108, 110, 112, and 114. The interior angle between each pair of adjacent sides 108, 110, 112, and 114 is 90 degrees.

Helmet 10 consists of two of each of fiber layers 54, 56, 58, and 60 that are impregnated with a polymer, placed in a female mold so that certain of the layers 54, 56, 68, and 60 overlap (as described in detail below), and subjected to heat and a vacuum while the polymer cures and hardens. The polymer used is preferably a thermosetting polymer such as epoxy, but other types of polymers are within the scope of the invention, including thermoplastic polymers such as polycarbonate, including that sold under the Lexan trademark, and acrylonitrile butadiene styrene (ABS).

FIGS. 2-6 show the orientation of the layers 54, 56, 58, and 60 within the helmet 10. The helmet 10 is shown in FIGS. 2-6 as it comes out of the mold before excess material, or flashing, 116 is cut away from the helmet 10. The flashing 116 is positioned below a lower peripheral edge 118 of the helmet 10. Further, the outer peripheral edge of the layers 54, 56, 58, 60*a*, and 60*b* is shown in FIGS. 2-6 as a rectangular border to indicate that the actual edge of the layers 54, 56, 58, 60*a*, and 60*b* is positioned somewhere within the border. The helmet 10 includes two of layer 54, as shown in FIGS. 2, 3, 4, and 6, that overlap in the same location. The two layers 54 cover all of the front 20 and bill 32 and portions of the crown 24, left side 26, right side 28, and ear flap 30 adjacent to front 20. The helmet 10 also includes two of layer 56, shown in FIGS. 4, 5 and 6, that overlap in the same location. The two layers 56 cover the majority of the ear flap 30 and portions of the rear 22, crown 24, and right side 28. The helmet includes two of layer 58, as shown in FIGS. 2, 5, and 6, that overlap in the same location. The two layers 58 cover portions of the rear 22, crown 24, and left side 26. The helmet also includes two of layer 60, shown as 60*a* and 60*b* in FIGS. 2-6, positioned in different locations. Layer 60*a* covers portions of the front 20, right side 28, ear flap 30, and bill 32, and layer 60*b* covers portions of the rear 22, right side 28, and ear flap 30.

Figure 3:
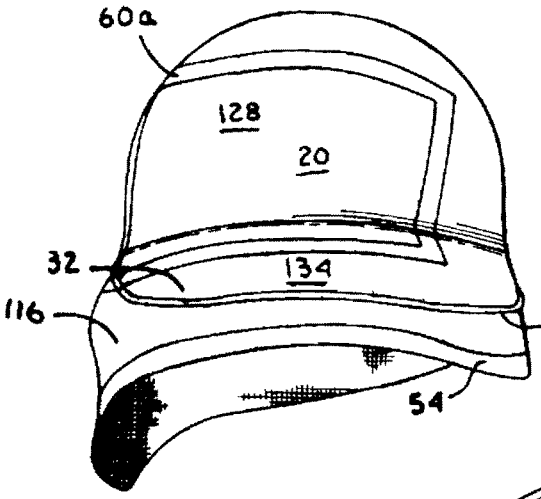
FIG. 3 is a front elevational view of the helmet of FIG. 1A.
Figure 4:
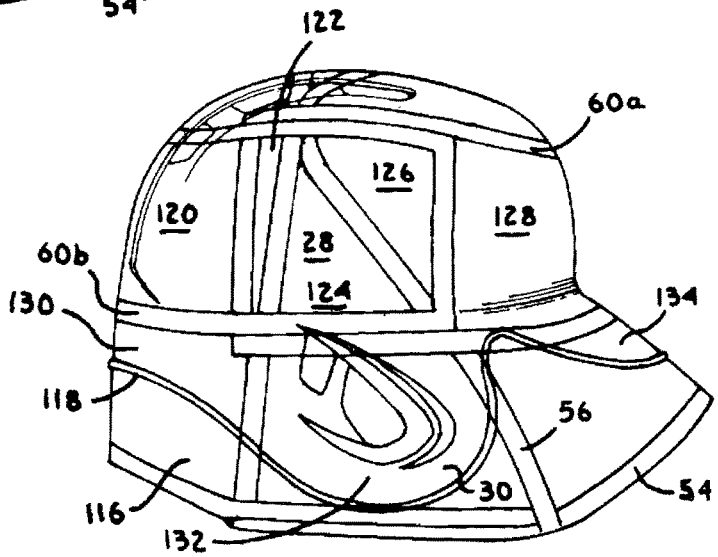
FIG. 4 is a right elevational view of the helmet of FIG. 1A.

Because the layers 54, 56, 58, 60*a*, and 60*b* overlap at different locations of the helmet, there are different numbers of overlapping layers 54, 56, 58, 60*a*, and 60*b* at different areas of the helmet. The overlapping layers 54, 56, 58, 60*a*, and 60*b* are positioned to give the helmet 10 a desired stiffness and level of protection, while minimizing the weight of the helmet 10 to a level that is comparable with a conventional baseball batting helmet. Referring to FIG. 4, the following areas of the right side 28 and ear flap 30 of the helmet 10 have the following numbers of overlapping layers: area 120 has three layers, area 122 has four layers, area 124 has six layers, area 126 has four layers, area 128 has three layers, area 130 has two layers, and area 132 has four layers. Referring to FIG. 3, the following areas of the front 20 and bill 32 have the following numbers of overlapping layers: area 128 has three layers and area 134 has two layers. Referring to FIG. 2, the following areas of the left side 26 have the following number of overlapping layers: area 134 has two layers, area 136 has four layers, and area 138 has two layers. Referring to FIG. 5, the following areas of the rear 22 have the following number of overlapping layers: area 120 has three layers, area 130 has two layers, area 138 has two layers, area 140 has three layers, area 142 has five layers, and area 144 has four layers. Referring to FIG. 6, the following areas of the crown 24 have the following number of overlapping layers: area 134 has two layers, area 136 has four layers, area 138 has two layers, area 146 has four layers, area 148 has two layers, and area 150 has four layers.

The helmet 10 includes a higher concentration of layers 54, 56, 58, 60*a*, and 60*b* in right side 28 and ear flap 30 because the helmet 10 is designed for a left handed batter and those are the areas of the helmet 10 that face a pitcher and are more likely to be hit by a pitch when a batter wears the helmet 10. The right side 28 and ear flap 30 together comprise a "critical impact area" because they are more likely to be struck than the other areas of the helmet. The critical impact area contains a greater concentration of fibers than the remainder of the helmet 10 because there are more overlapping layers 54, 56, 58, 60*a*, and 60*b* in the right side 28 and ear flap 30. If the helmet 10 was designed to be worn by a right handed batter and had an ear flap similar to ear flap 30 depending from the left side 26 of the helmet, then the critical impact area would be on the opposite side of the helmet and the left side 26 would contain a greater concentration of fibers and overlapping layers. If the helmet 10 was designed to be worn by both right and left handed batters and had ear flaps 30 on both sides 26 and 28 of the helmet, then the helmet would have two critical impact areas with a greater concentration of fibers and overlapping layers. Helmets within the scope of the present invention used for other purposes, such as football or motorcycling, may have multiple critical impact areas positioned at different locations of the helmet that need enhanced stiffness and levels of protection.

The critical impact area of helmet 10 at right side 28 and ear flap 30 has one area 124 with six overlapping layers, which consist of layers 54, 56, 60*a*, 60*b*, 56, and 54 in order from the inner surface 18 to the outer surface 16. The layers 54, 56, 60*a*, 60*b*, 56, and 54 are oriented at this location so that the weft and warp tows 62 and 64 (FIG. 8) of different layers are positioned at angles with respect to each other in order to increase the stiffness and enhance the level of protection of the helmet 10. The angular orientation of the layers is described herein with reference to a coordinate system whereby horizontal fibers are deemed to be at 0 degrees and vertical fibers are deemed to be at 90 degrees. Thus, at area 124 the layers 54, 56, 60*a*, 60*b*, 56, and 54 have weft and warp tows 62 and 64 positioned at the following angles: first layer 54 has tows at 0 and 90 degrees, first layer 56 has tows at +45 and −45 degrees, layer 60*a* has tows at 0 and 90 degrees, layer 60*b* has tows at 0 and 90 degrees, second layer 56 has tows at +45 and −45 degrees, and second layer 54 has tows at 0 and 90 degrees.

As shown in FIG. 7, the padding 14 consists of four discrete padding elements: an elongate rectangular pad 152 that is affixed to the inner surface 18 of the front 20, left side 26 and right side 28 adjacent crown 24, an oval shaped crown pad 154 affixed to the center of crown 24, a triangular shaped rear pad 156 affixed to the rear 22, and a U-shaped ear flap pad 158 affixed to ear flap 30. Each pad element 152, 154, 156, and 158 includes two layers, a first layer of vinyl nitrile foam that is adjacent the inner surface 18, and a second layer of polyurethane open cell comfort foam that is adjacent the wearer's head. It is within the scope of the invention for the padding 14 to be affixed to different locations of the helmet 10 and for the padding to comprise different materials than the preferred materials listed above.

The outer shell 12 of helmet 10 preferably has a weight of between approximately 13.5 to 17.5 ounces, and most preferably between approximately 15.5 to 16.5 ounces. The helmet 10, or the outer shell 12 and padding 14 combined, preferably has a weight of between approximately 17 to 21 ounces, and most preferably between approximately 18 to 20 ounces. The offset of the helmet 10, which is the distance between a wearer's head and inner surface 18, or the thickness of padding 14, is preferably between approximately 0.25 to 1.25 inches. In other embodiments, the helmet 10 may have an offset or padding 14 thickness of between approximately 0.25 to 0.75 inches, between approximately 0.25 to 0.5 inches, or approximately 0.28 inches. The helmet 10 preferably comes in two sizes, small and large. The small size preferably has a length of between 277 to 297 mm, a width of between 188 to 208 mm, and a height of between 205 to 225 mm. The small size most preferably has a length of 287 mm, a width of 198 mm, and a height of 215 mm. The large size preferably has a length of between 290 to 310 mm, a width of between 194 to 214 mm, and a height of between 212 to 232 mm. The large size most preferably has a length of 300 mm, a width of 204 mm, and a height of 222 mm. The weight, offset, and dimensions of the helmet 10 are preferably comparable with a conventional baseball batting helmet.

The helmet, or outer shell 12 and padding 14 combined, preferably has a Severity Index, as defined in the National Operating Committee on Standards for Athletic Equipment's (NOCSAE) Standard Test Method and Equipment Used in Evaluating the Performance Characteristics of Protective Headgear/Equipment (NOCSAE DOC 001-11m11), of not greater than 750, and most preferably not greater than 500, when tested in accordance with NOCSAE's Standard Performance Specification for Newly Manufactured Baseball/Softball Batter's Helmets (NOCSAE DOC 022-10m11a), as modified so that all projectiles used in the test are baseballs, the velocity of all baseballs used in the test is approximately 90 miles per hour, and all tests are conducted at ambient temperature.

Helmet 10 is preferably relatively stiff such that it resists flexing when a force is applied to its left and right sides 26 and 28. When the helmet 10 is positioned between two flat plates such that each plate abuts one of the left and right sides 26 and 28 and the plates compress the left and right sides 26 and 28 toward each other, the plates must exert a pressure of preferably greater than 60 pounds per square inch to decrease the distance between the left and right sides 26 and 28 by one inch. In another embodiment of helmet 10, the plates must exert a pressure of between approximately 80 to 120 pounds per square inch to decrease the distance between the left and right sides 26 and 28 by one inch. It is believed that the relatively high stiffness of the helmet 10 makes it more protective and lowers its Severity Index.

The outer shell 12 is preferably formed and cured in the mold 200 shown in FIG. 12. The mold 200 has two halves 202 and 204 that join together with fasteners received by holes (not shown) in the halves 202 and 204. The halves 202 and 204 form a solid box-like structure with a cavity 206 formed therein. The cavity 206 has a surface 208 that is the inverse of the outer surface 16 of outer shell 12. Thus, the surface 208 includes a front 210 region, rear region 212, crown region 214, left side region 216, right side region 218, ear flap region 220, and bill region 222 that are the inverse of the corresponding front 20, rear 22, crown 24, left side 26, right side 28, ear flap 30, and bill 32 of the outer shell 12. The surface 208 includes a flash line 224, which corresponds with the peripheral edge 118 of the helmet.

The outer shell 12 is formed in mold 200 in accordance with the following process described in connection with FIGS. 12-17. First, the mold 200 is heated to approximately 135 to 140 degrees Fahrenheit, and a mold release is applied to the surface 208. The mold release is preferably a 19W mold release manufactured by Axel Plastics Research Laboratories Inc.

A surface coat of epoxy resin is then applied to the surface 208. The surface coat preferably consists of two coats of epoxy resin each mixed with a desired color pigment, preferably black. The first coat preferably consists of a mixture of two ounces of epoxy resin sold by System Three Resins, Inc. under the trademark QuikFair, one ounce of epoxy resin sold by System Three Resins, Inc. under the trademark Phase Two, and black pigment. The first coat is evenly applied to the surface 208 so that it extends approximately one inch past flash line 224. The first coat is allowed to sit for approximately 15 to 18 minutes until it is tacky but not fully cured. The second coat, which preferably consists of a mixture of one ounce of QuikFair epoxy resin, two ounces of Phase Two epoxy resin, and pigment, is applied to the surface 208 over the first coat. The second coat is not allowed to sit for any appreciable amount of time before the subsequent layup steps set forth below are undertaken. The surface coat application promotes excellent adhesion between the fiber layers and the surface coat, prevents the fiber from being exposed on the outer surface 16 of the outer shell 12 due to application of the first, tacky coat, and prevents the outer surface 16 from chipping when impacted. After the surface coat is applied, the mold 200 is placed in a vacuum heat box (not shown).

Next, epoxy resin is applied to layer 54 (FIG. 8), and the layer 54 is placed into the mold 200 in the position shown in FIG. 13 while the second surface coat is still wet. Preferably, 12 ounces of Phase II epoxy resin is prepared for application to all of the carbon fiber layers 54, 56, 58, and 60 used to make helmet 10 as described herein. The epoxy resin is applied to each side of layer 54 and a squeegee is used to remove excess resin from each side. Layer 54 preferably has a weight of between approximately 2.2 to 2.4 ounces, and a weight of between approximately 3.4 to 3.8 ounces when coated with epoxy resin. Referring to FIG. 13, the layer 54 is placed into the mold 200 so that the slit 86 is positioned in the crown region 214, side 72 extends from the crown region 214 to the edge of the left side region 216 just beyond the flash line 224, side 84 extends from the crown region 214 to the edge of the ear flap region 220 just beyond the flash line 224, side 66 is generally parallel to the flash line 224 and extends from the ear flap region 220 to the bill region 222, side 70 is generally parallel to the flash line 224 and extends from the left side region 216 to the bill region 222, and side 68 is generally parallel to the flash line 224 and extends across the bill region 222. Preferably, the mold 200 includes indicator marks 226 and 228 to assist in aligning the layer 54 in the mold 200. Indicator mark 226 aligns with the corner of layer 54 where sides 66 and 84 meet, and indicator mark 228 aligns with the corner of layer where sides 70 and 72 meet.

After layer 54 is placed in the mold 200, epoxy resin is applied to layer 56 (FIG. 9) in the same manner as described above with respect to layer 54. Layer 56 preferably has a weight of between approximately 1.15 to 1.35 ounces, and a weight of between approximately 1.75 to 2 ounces when coated with epoxy resin. Referring to FIG. 14, the layer 56 is placed into the mold 200 over layer 54 such that side 94 is placed just beyond flash line 224 and extends from the rear region 212 around to the ear flap region 220. Side 92 extends from the ear flap region 220 to the crown region 214, side 90 extends from the crown region 214 to an upper portion of the rear region 212, and side 88 extends across the rear region 212 to beyond the flash line 224. Preferably, the mold 200 includes an indicator mark 230 that aligns with the corner of layer 56 where sides 88 and 94 meet.

Next, epoxy resin is applied to layer 58 (FIG. 10) in the same manner as described above with respect to layer 54. Layer 58 preferably has a weight of between approximately 0.8 to 1 ounces, and a weight of between approximately 1.25 to 1.55 ounces when coated with epoxy resin. Referring to FIG. 15, the layer 58 is placed into the mold 200 over layers 54 and 56 such that side 96 extends across the rear region 212 just beyond and approximately parallel to the flash line 224. Sides 106 and 104 extend from the rear region 212 across the left side region 216 just beyond the flash line 224, side 102 extends from the left side region 216 to the crown region 214, and sides 100 and 98 extend from the crown region 214 back to the rear region 212. The mold 200 includes an indicator mark 232 that aligns with the corner of layer 58 where sides 96 and 98 meet.

Referring to FIG. 16, resin is then applied to layer 60*a* in the same manner as described above with respect to layer 54. Layer 60*a* preferably has a weight of between approximately 1 to 1.25 ounces, and a weight of between approximately 1.55 to 1.85 ounces when coated with epoxy resin. The layer 60*a* is placed into the mold 200 over layers 54, 56, and 58 such that side 108*a* extends from a rear portion of the right side region 218 to and across the bill region 222. Side 110*a* extends from the bill region 222 into the front region 210, side 112*a* extends across the front region 210 to a portion of the right side region 218 adjacent the crown region 214, and side 114*a* extends across the right side region 218.

Referring to FIG. 17, resin is then applied to layer 60*b* in the same manner as described above with respect to layer 54. Layer 60*b* preferably has a weight that is the same as layer 60*a* both when dry and coated with epoxy resin. The layer 60*b* is placed into the mold 200 over layers 54, 56, 58, and 60*a* such that side 108*b* extends from a front portion of the right side region 218 to and across the rear region 212. Side 110*b* extends across the rear region 212, side 112*b* extends from the rear region 212 to the right side region 218 adjacent the front region 210, and side 114*b* extends across the right side region 218.

After layer 60*b* is placed in the mold 200, another of each of layers 54, 56, and 58 is wetted with epoxy resin and placed in the mold 200 in the same manner and location as described above with respect to the first of layers 54, 56, and 58.

After all of the carbon fibers layers 54, 56, 58, 60*a*, and 60*b* are placed in the mold 200, a peel ply is placed in the mold over the layers so that the inner surface 18 (FIG. 7) of outer shell 12 is bondable. Preferably, the peel ply used is a peel ply sold under the name Bleeder Lease B by Airtech International, Inc., and the peel ply is cut into a 36 inch by 30 inch rectangle.

Next, a perforated ply is placed in the mold over the peel ply in order to pull excess resin from the layers 54, 56, 58, 60*a*, and 60*b* and make the breather/bleeder described below easier to remove. Preferably, the perforated ply used is a perforated ply sold under the name Release Bag 125 by Airtech International, Inc., and the perforated ply is cut into a 36 inch by 30 inch rectangle.

A breather/bleeder is then placed in the mold over the perforated ply in order to distribute the vacuum pressure evenly across the part and soak up excess resin removed while the layers 54, 56, 58, 60*a*, and 60*b* cure. Preferably, the breather/bleeder used is a breather/bleeder sold under the name Econoweave 44 by Airtech International, Inc., and the breather/bleeder is cut into a 36 inch by 30 inch rectangle.

A silicone vacuum bag is then placed over the mold 200, and the excess peel ply, perforated ply, and breather/bleeder are tucked into the mold cavity 206 (FIG. 12). The silicone vacuum bag is pressed into a seal channel (not shown) on the heat box (not shown) within which the mold 200 is positioned to seal the mold cavity 206 and prevent air from entering the mold cavity. The silicone vacuum bag includes a monitoring port for connection to a vacuum pressure gauge and a vacuum port for connection to a vacuum.

The vacuum is powered on so that the pressure within the mold cavity 206 is at least 25 inches of mercury less than atmospheric pressure. The mold 200 is heated so that the vacuum bag is at a temperature of between 175 to 190 degrees Fahrenheit when measure with an infrared temperature gun. After approximately 45 minutes, the mold 200 is removed from the heat box and the helmet 10 is removed from the mold 200 by separating the mold halves 202 and 204.

Once the helmet 10 is removed from the mold 200, the flashing 116 (FIGS. 2-6) is cut away from the helmet and the holes 34, 36, 44*a-c*, and 52*a-c* (FIGS. 1B and 6) are cut out. The outer surface 16 of the helmet 10 is alternately sanded and sprayed with a sandable paint until the surface 16 is smooth. Then, the outer surface 16 is painted a desired color, and the padding 14 is affixed to the inner surface 18 of the outer shell 12.

Figure 18:
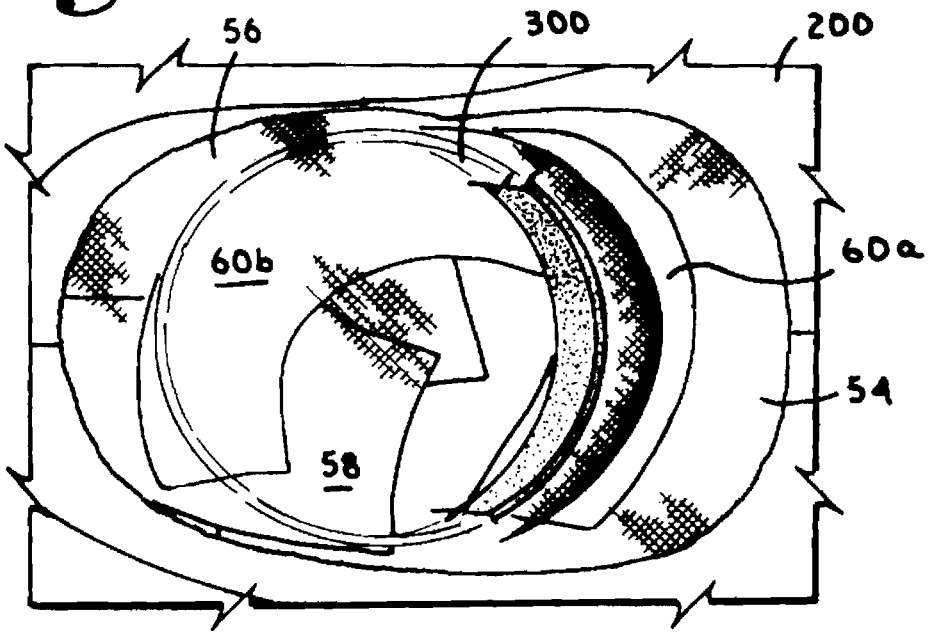
FIG. 18 is a top plan view of the mold with an alternative foam band placed in the mold.

Referring now to FIG. 18, an optional foam band 300 may be placed within the mold 200 over layers 54, 56, 58, 60*a*, and 60*b* before the second of layers 54, 56, and 58 are placed in the mold 200 over the foam band 300. The foam band 300 is preferably approximately 1 inch wide and has a thickness of approximately ⅛ inch.

Although the preferred helmet 10 and process for making the helmet 10 are described above, it is within the scope of the invention for the helmet 10 to comprise different materials and for the process for making the helmet to differ. For example, the layers 54, 56, 68, 60*a*, and 60*b* used to make the helmet may be fiber layers that are pre-impregnated with a polymer such as a thermoplastic or thermosetting polymer to simplify the process for making the helmet 10.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A helmet, comprising:

an outer shell made from a fiber reinforced material, wherein said outer shell comprises a critical impact area that contains a greater concentration of fibers than the remainder of said outer shell, wherein said outer shell comprises a front, a rear, a crown, a first side and a second side, wherein the critical impact area is at least partially positioned in the first side, and wherein said outer shell comprises:

a first fiber layer that forms at least a portion of each of the front, the crown, the first side and the second side;

a second fiber layer that forms at least a portion of each of the rear, the crown, and the first side;

a third fiber layer that forms at least a portion of each of the rear, the crown, and the second side;

a fourth fiber layer that forms at least a portion of each of the front and the first side; and a fifth fiber layer that forms at least a portion of each of the rear and the first side.

2. The helmet of claim 1, wherein said outer shell is configured for use as a baseball batting helmet and said outer shell comprises an ear flap joined with and extending downward from said first side.

3. The helmet of claim 2, wherein said outer shell comprises a plurality of overlapping fiber layers that comprise said first, second, third, fourth, and fifth fiber layers.

4. The helmet of claim 3, wherein each of said fiber layers comprises a weave of weft and warp tows oriented generally perpendicular to each other, and wherein each of said weft and warp tows comprises a plurality of fibers generally oriented in the same direction.

5. The helmet of claim 4, wherein said critical impact area comprises at least two of said fiber layers oriented with respect to each other such that said weft and warp tows of one of said fiber layers are each positioned at a 45 degree angle with respect to said weft and warp tows of the other of said fiber layers.

6. The helmet of claim 4, wherein there are six of said overlapping fiber layers in at least a portion of said critical impact area, three of said overlapping fiber layers in at least a portion of said front, four of said overlapping fiber layers in at least a portion of said left side or right side that does not include said critical impact area, five of said overlapping fiber layers in at least a portion of said rear, and four of said overlapping fiber layers in at least a portion of said crown.

7. The helmet of claim 4, wherein said weave comprises a four harness satin weave.

8. The helmet of claim 4, wherein each of said weft and warp tows comprises 12,000 fibers.

9. The helmet of claim 4, wherein each of said fiber layers comprises a weight per area of 660 grams per square meter.

10. The helmet of claim 2, wherein said outer shell comprises outer and inner surfaces, and further comprising padding coupled to said inner surface.

11. The helmet of claim 10, wherein said outer shell and padding combined have a weight of between 17 to 21 ounces.

12. The helmet of claim 11, wherein said outer shell and padding combined have a weight of between 18 to 20 ounces.

13. The helmet of claim 10, wherein said padding comprises a thickness of between 0.25 to 1.25 inches.

14. The helmet of claim 13, wherein said padding comprises a thickness of between 0.25 to 0.75 inches.

15. The helmet of claim 14, wherein said padding comprises a thickness of between 0.25 to 0.5 inches.

16. The helmet of claim 15, wherein said padding comprises a thickness of 0.28 inches.

17. The helmet of claim 10, wherein the combination of said outer shell and said padding have a Severity Index, as defined in the National Operating Committee on Standards for Athletic Equipment's NOCSAE DOC 001-11m11 titled Standard Test Method and Equipment Used in Evaluating the Performance Characteristics of Protective Headgear/Equipment, of not greater than 750 when tested in accordance with the National Operating Committee on Standards for Athletic Equipment's NOCSAE DOC 022-10m11a titled Standard Performance Specification for Newly Manufactured Baseball/Softball Batter's Helmets as modified so that all projectiles used in the test are baseballs, the velocity of all baseballs used in the test is 90 miles per hour, and all tests are conducted at ambient temperature.

18. The helmet of claim 17, wherein the combination of said outer shell and said padding have a Severity Index, as defined in the National Operating Committee on Standards for Athletic Equipment's NOCSAE DOC 001-11m11 titled Standard Test Method and Equipment Used in Evaluating the Performance Characteristics of Protective Headgear/Equipment, of not greater than 500 when tested in accordance with the National Operating Committee on Standards for Athletic Equipment's NOCSAE DOC 022-10m11a titled Standard Performance Specification for Newly Manufactured Baseball/Softball Batter's Helmets as modified so that all projectiles used in the test are baseballs, the velocity of all baseballs used in the test is 90 miles per hour, and all tests are conducted at ambient temperature.

19. The helmet of claim 2, wherein said right and left sides move closer to each other by 1 inch when a pressure of greater than 60 pounds per square inch is applied to said left or right side.

20. The helmet of claim 19, wherein said right and left sides move closer to each other by 1 inch when a pressure of between 80 to 120 pounds per square inch is applied to said left or right side.

21. The helmet of claim 1, wherein said shell comprises a fiber reinforced polymer, and wherein said fiber comprises carbon and said polymer comprises epoxy.

* * * * *